United States Patent [19]

Crotti

[11] 3,935,622

[45] Feb. 3, 1976

[54] APPARATUS FOR PRODUCING A COILED THREAD PACKAGE

[76] Inventor: Renato Crotti, 71, Corso Canalgrande, Modena, Italy, 41100

[22] Filed: Jan. 28, 1974

[21] Appl. No.: 436,981

[52] U.S. Cl. ..... 28/21

[51] Int. Cl.[2] ..... B65H 51/02

[58] Field of Search ..... 28/21; 19/159 R; 242/82, 242/83

[56] References Cited

UNITED STATES PATENTS

| | | | |
|---|---|---|---|
| 2,958,920 | 11/1960 | Erb | 28/21 |
| 3,226,794 | 1/1966 | Erb | 28/21 |
| 3,241,196 | 3/1966 | Forngs et al. | 19/159 R |
| 3,270,979 | 9/1966 | Whitacre | 242/82 |

FOREIGN PATENTS OR APPLICATIONS

| | | | |
|---|---|---|---|
| 1,302,522 | 7/1962 | France | 242/82 |

*Primary Examiner*—Dorsey Newton

*Attorney, Agent, or Firm*—Larson, Taylor and Hinds

[57] ABSTRACT

A rotating receiving plate is provided having a vertical axis, onto which the coiled yarn package is formed. Said receiving plate is urged upwardly against a rotating depositing disc, the axis of rotation of which is eccentric with respect to the axis of rotation of the receiving plate. The depositing disc is carried by a rotating hollow shaft presenting an upper open end and a radial bore in correspondence of its bottom end integral with the depositing disc. Integral in rotation with the depositing disc there is provided a thread guide. To the supporting frame there is secured a fixed member presenting an outer annular friction surface. The yarn is withdrawn from a suitable supply, passes through the hollow shaft, out of the radial bore, it is further laid onto at least a portion of the annular track and it is hence positively fed, through a bore provided in the depositing disc, onto the receiving plate, in loops progressing along an annular path, to form a coiled yarn package.

10 Claims, 5 Drawing Figures

Fig.2

APPARATUS FOR PRODUCING A COILED THREAD PACKAGE

BACKGROUND OF THE INVENTION

1. Field of the Invention

The present invention relates to the coiling of a substantially continuous length of textile material, in the form of thread, hereinafter generically referred to as yarn or thread. More particularly, this invention relates to an apparatus for producing a coiled yarn package by feeding loops of yarn on a receiving plate in such a manner that the loops progress along a substantially annular path.

An apparatus for producing a coiled yarn package, of the type above mentioned, is described in my U.S. Pat. No. 3,816,889, issued June 18, 1974.

2. Description of the Prior Art

In the prior art there are known apparatuses for producing a coiled yarn package of the mentioned type, which basically comprise a receiving plate upon which a depositing disc deposits the yarn in loops, there being provided a relative movement between the depositing disc and the receiving plate, so that the loops progress along an annular path to form successive layers of yarn.

The receiving plate and the depositing disc are elastically urged the one towards the other, so that the yarn is actually drawn, from suitable supply means to a through bore provided in the depositing disc, by the combined action of the rotating depositing disc and of the receiving plate, from which it is clamped while being deposited in loops. This is due to the fact that the underside of the depositing disc, which is constructed with such a diameter as to cover the whole upper surface of the package being formed, has the lowest possible frictional coefficient, while the receiving plate and the upper surface of the package being formed present a higher degree of adhesion or sticking capacity with respect to the frictional resistance generated by the side of the depositing disc which is in contact with the yarn package being formed.

Basically, the formation of a yarn package of the type above described can be accomplished in two ways. According to a first mode of operation, a rotating thread-depositing member or depositing disc is provided having a fixed axis of rotation, from which the thread is deposited in circular rings. Since however also the surface onto which the thread is deposited is rotating about an axis which is eccentric with respect to the axis of rotation of the depositing member, the thread will be deposited onto the receiving surface or plate in loops which progress along an annular path.

According to a second mode of operation, the receiving surface does not rotate, while the thread depositing member or depositing disc, besides rotating about its own axis, revolves also about a fixed axis which is eccentrically arranged with respect to its above mentioned axis of rotation, i.e. the axis of rotation of the thread depositing member rotates about a fixed spaced-apart axis, which coincides with the center of the package being formed.

In any case, as appears evident from the above, it is necessary to provide for a relative circular movement between the receiving plate and the axis of rotation of the depositing disc.

In the prior art apparatus according to U.S. Pat. No. 3,226,794 (ERB) the thread is drawn from the supply bobbin following to the above mentioned relative movement between the receiving plate and the axis of the depositing disc, due to the mentioned friction or sticking capacity which exists between the thread being deposited and the surface of the receiving plate or of the latest layer of yarn loops which has been deposited. Thus, the draw-off force which is necessary for drawing the yarn from the supply bobbin, is directly exerted on the said latest layer of yarn loops which has been deposited. It may happen therefore, particularly, in the case of smooth yarns for example of synthetic fibers, that this draw-off force, directly exerted on the yarn layers already deposited, greatly disturbs the formation of regular loops, and, consequently, the formation of a yarn package having the desired characteristics.

In order to overcome the mentioned inconveniences, and to increase the clamping force with which the thread is clamped between the depositing disc and the receiving plate (or latest deposited layer of loops) it has been proposed, in the mentioned U.S. Pat. No. 3,226,794, to provide a contact element for pressing the thread being deposited onto the receiving plate, said contact element being arranged on the rotating depositing disc and acting through said disc through any conveniently provided bore or slot. The mentioned contact element may have the form of a curved leaf spring, or of a roller journalled onto said depositing disc. In both cases, the pressure action of the contact member which projects into the package beyond the surface of the depositing disc, disturbs the formation of the package, and, whenever it is necessary to provide on the depositing disc a slot larger than a simple through bore, such as for example it is required in the case of the roller, also the presence of this slot or aperture disturbs the regular formation of the package.

In the prior art apparatus according to U.S. Pat. No. 3,478,399 (WYATT) there are provided, between the supply bobbin and the through bore in the depositing member, a pair of feed rollers, which thus draw off the thread from the supply bobbin and feed it at the desired speed to the depositing member.

In the prior art apparatus according to Italian Pat. No. 941,625 (CROTTI) the positive feeding of the yarn at the exact speed which is required by the drawing action of the depositing disc and of the associated receiving plate is obtained by providing a feeding roller which is integral in rotation with the depositing disc, and travels along a fixed annular track. The yarn to be fed to the through bore in the depositing disc is clamped between the feeding roller and the annular track, so as to be positively fed to the through bore in the depositing disc, upon rotation of the said depositing disc.

However, in the apparatuses of the two latest mentioned devices (U.S. Pat. No. 3,478,399 and Italian Pat. No. 941,625), though same operate in a satisfactory manner, there is the problem that the feed rollers are devices which operate at high speed, and therefore are subject to all the disadvantages associated with this type of devices, disadvantages which originate from the connected problems of the bearing, lubrication and, if requested, driving into rotation of the said rollers.

SUMMARY OF THE INVENTION

According to the invention, an apparatus for producing a coiled thread package of the mentioned type is provided which comprises a draw-off thread guide arranged on the depositing disc at a certain distance from its axis of rotation, and a fixed thread take-up member which presents an annular outer friction surface which is co-axial to the said vertical axis of the depositing disc. The thread, coming from suitable supply means, such as a bobbin, is passed through the draw-off thread guide on the depositing disc, from this draw-off thread guide onto the annular friction surface of the fixed take-up member, in a direction which is contrary to the direction of rotation of the depositing disc, so as to be laid on the said friction surface for at least an arc of circumference, and hence (i.e. from the annular friction surface) is guided into the through bore in the depositing disc, to be deposited onto the opposed receiving plate.

Upon rotation of the depositing disc the thread is drawn off from the supply bobbin by the movement of the draw-off thread guide arranged on the said depositing disc, due to the fact that the said draw-off thread guide deposits same onto the fixed annular friction surface. From the friction surface the thread is guided, as above said, into the through bore in the depositing disc, so that the said rotation of the depositing disc will also promote the detachment of the thread from the annular friction surface and its deposition, through the bore in in the depositing disc, onto the receiving plate.

It appears evident, from the above, that exactly the same amount of thread is drawn-off from the supply bobbin and fed to the through bore in the depositing disc, so that it is ensured that the correct amount required of yarn is deposited, while the drawing force which is necessary for drawing the said thread from the bobbin is achieved by the combined action of the rotating draw-off thread guide on the depositing disc and the cooperating annular friction surface of the fixed take-up member. The said annular friction surface presents, with respect to the thread which is deposited, a friction coefficient which is such as to avoid the possibility of the said thread to slip onto said surface. Therefore, it is avoided the possibility that the draw-off force be applied at the point of deposition, i.e. in correspondence of the through bore in the depositing disc, while at the same time it is also avoided the use of high speed revolving rollers, such as the feed rollers mentioned in the above prior art apparatuses.

These and other features of the invention will be clearly understood from the following description of some preferred embodiments thereof with reference to the accompanying drawings, and the novel features will be particularly pointed out in the appended claims.

DESCRIPTION OF THE PREFERRED EMBODIMENTS

Figure 1:
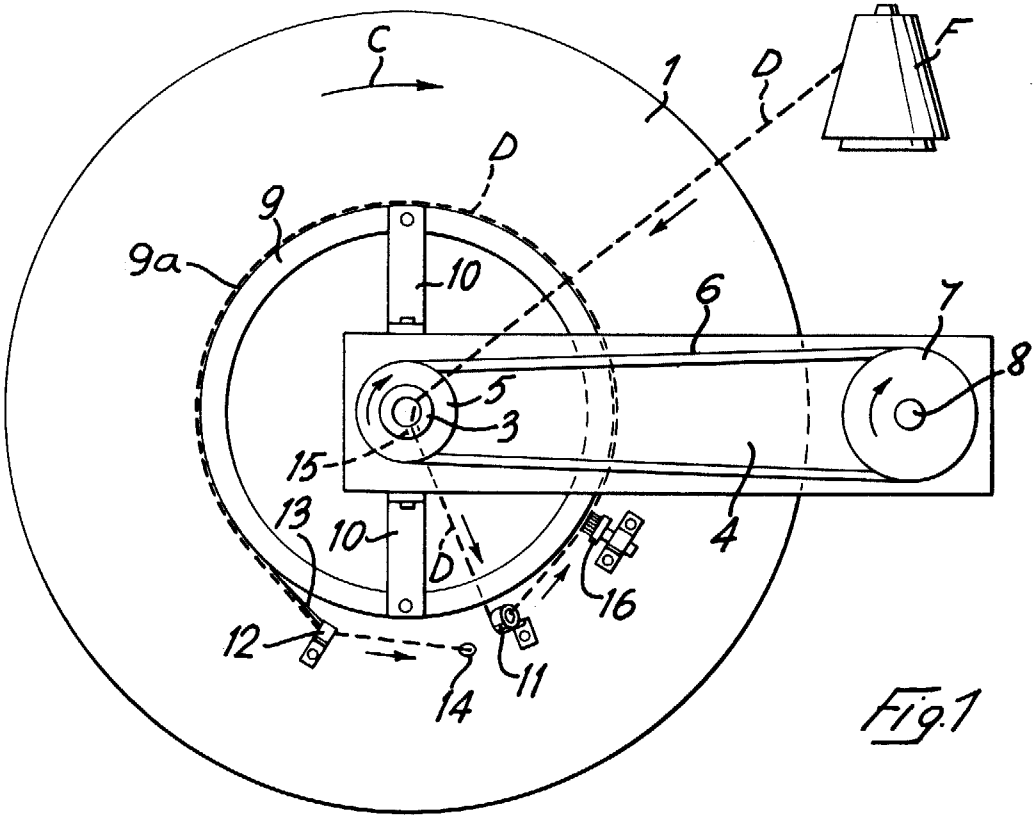
FIG. 1 is a diagrammatic plan view from the top of an apparatus according to the invention.
Figure 2:
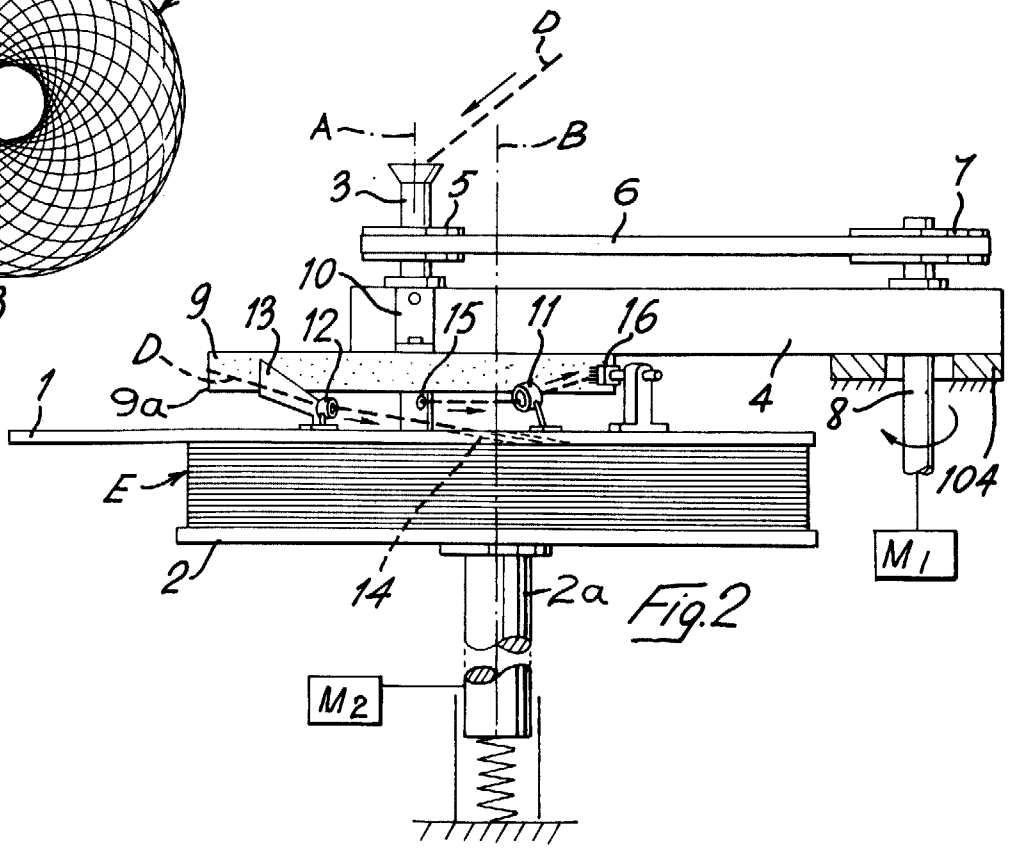
FIG. 2 is a side elevation view of the apparatus according to FIG. 1.
Figure 3:
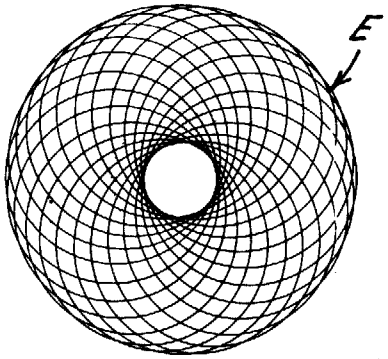
FIG. 3 shows diagrammatically a pattern of deposition of the yarn as effected by the apparatus according to the invention.

The apparatus shown in FIGS. 1 and 2 serves for the production, from a supply bobbin F of suitable textile material, of a coiled yarn package E (see particularly FIGS. 2 and 3). The coiled thread package E shown in FIG. 3 is constructed of a continuous length of thread disposed in substantially annular layers forming a coil, each layer being composed of a series of loops which progress along the annular layer of the coil, and in the example shown the diameter of each loop is greater than the radius of the package. Of course, the said diameter of a loop can be smaller than the said radius of the package, as it is known from the prior art.

The apparatus comprises a substantially horizontal depositing disc 1 under which there is arranged a receiving disc or plate 2. The receiving plate 2 is elastically urged upwardly, in a known manner, as shown in my said U.S. Pat. No. 3,816,889, and as shown schematically in FIG. 2 by spring S acting on the lower end of shaft 14*a* of receiving disc 2 against the opposed surface of the depositing disc 1, and is positively rotated around its axis B by rotation of its shaft 2*a* by a motor means shown schematically at $M_2$. The depositing disc 1 is fastened at the lower end of a co-axial hollow shaft 3 the axis of which coincides with the axis of rotation A of the depositing disc, which axis of rotation A is eccentric with respect to the axis of rotation B of the receiving plate 2. The hollow shaft 3 (and associated depositing disc 1) is rotatably supported by an overhanging structure 4 secured to the machine frame, a portion of which frame is shown in FIG. 2 at 104 with conventional slant lines therebelow representing the fixed character of this part. The frame is shown in greater detail in my said U.S. Pat. No. 3,816,889. The diameter of the depositing disc 1 is such that the disc 1 always covers the package E in formation onto the receiving plate 2.

The receiving surface of the plate 2, i.e. the surface onto which the thread D is deposited, presents a high friction coefficient with respect to the thread itself, and for example the said receiving plate 2 is covered on its upper side with a layer of soft resilient material, such as foam rubber, or any suitable textile fabric. The underside of the depositing disc 1 presents, on the contrary, a minimum friction coefficient, and can be constructed, for example, of highly polished metal.

The hollow shaft 3 is driven into rotation through a belt and pulley transmission 5, 6, 7, in which the driving pulley 7 is actuated by a driving shaft 8 which is driven from a motor means shown schematically at $M_1$, in such a manner that the disc 1 associated with the hollow shaft 1, is rotated in the direction shown by the arrow C in FIG. 1.

Figure 4:
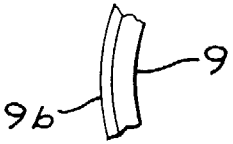
FIG. 4 is a plan view of FIG. 2, showing a modification of the invention.

At a short distance above the depositing disc 1 there is provided a fixed annular member 9, which is secured to the overhanging structure 4 by means of suitable radial supporting elements 10. This annular member 9, or take-up member, presents an outer annular surface 9*a* which is a surface of revolution, preferably cylindrical and co-axial to axis A of rotation of the depositing disc 1, and has a high friction coefficient with respect to the thread D to be deposited. This high friction coefficient can be obtained by constructing this outer annular surface 9*a* as a friction surface, which can be done either by mechanical machining of the surface, so as to render same rugose knurled or grooved or by coating or covering the said surface with a suitable friction material as shown schematically at 9*b* in FIG. 4, such as for example treated rubber.

In the depositing disc 1 there is provided eccentrically at a certain distance from the axis of rotation A, a through bore 14 for the passage of the thread D to be deposited onto the underlying receiving plate 2. This through bore 14 is preferably obtained as near as possible to the annular outer friction surface 9*a*. At a short distance from the mentioned through bore 14, and at preferably the same distance from the axis A, there is arranged, on the depositing disc, a draw-off thread guide 11, which is integral in rotation with the said depositing disc 1.

On the said depositing disc 1 there is further provided a supplementary thread guide 12, with an associated blade element 13 inclined towards the outer surface of member 9, in order to favour the detachment of the thread from the friction surface, as it will be seen after.

The hollow shaft 3 is provided in correspondence of its lower end at short distance from the depositing disc 1 and below the annular take-up member 9, with a radial bore 15. In correspondence of its upper end the shaft 3 presents a trumpet-like opening.

OPERATION OF THE PREFERRED EMBODIMENT

The operation of the just described apparatus is simple and evident:

The yarn or thread D, coming from the supply bobbin F, is guided into the trumpet like upper opening of hollow shaft 3, and out of the radial bore 15 of said shaft 3, which therefore practically acts as an inlet thread guide means which is co-axial (it actually coincides) with axis A of the depositing disc 1.

The thread D coming out of the bore 15 is passed through the draw-off thread guide 11 and from this latter onto an arc of circumference of the annular outer friction surface 9*a*, in a direction which is contrary to the direction of rotation C of the depositing disc.

At a certain point of the mentioned circumference (in the present case the arc of circumference measures about 270°) the thread abandons the friction surface and is passed through the suitably arranged thread guide 12, and from this latter into the through bore 14, to the opposite side of the depositing disc and onto the facing side of the receiving plate 2.

Upon rotation of the depositing disc 1 in the direction of arrow C it appears evident that the thread D is drawn from the supply bobbin F by the action of the draw-off thread guide 11 which rotates with respect to the fixed friction surface 9*a*. The thread D, more precisely, is laid by the said thread guide 11 onto the annular friction surface, and is wound onto same for the mentioned arc of circumference, until it is deviated and detached due to the action of the thread guide 12 and of the associated detaching blade 13 which is very close with its free inward directed extremity to the said friction surface, so as to almost shave or skim it and thus helps to detach the thread laid thereonto.

It is evident that, because of the friction surface 92*a* of the annular take-up member 9, the thread D will not be allowed to slip onto this surface, and therefore there will be avoided the possibility that the drawing force for drawing the thread from the bobbin D is applied directly at the point of actual feeding of the thread to the package in formation, i.e. in correspondence of the through bore 14. In order to increase the friction between the thread and the annular friction surface, the thread could be wound onto said surface also for more than 360°, i.e. more than one turn. Also, in order to ensure the proper "sticking" of the thread onto the said annular friction surface, suitable pressing means may be provided, such as for example the brush 16, integral in rotation with the depositing disc 1 and arranged immediately after (in the direction of rotation C) the draw-off thread guide 11, in correspondence of the point of tangency of the thread with the friction surface. These pressure means may also be realized as small air blows, suitably directed. Similarly, blowing means may be arranged in correspondence of the detachment thread guide 12 (and 13) to help to detach the thread. The small amount of air pressure required for these blows may be furnished by the same rotational movement of the depositing disc.

Figure 5:
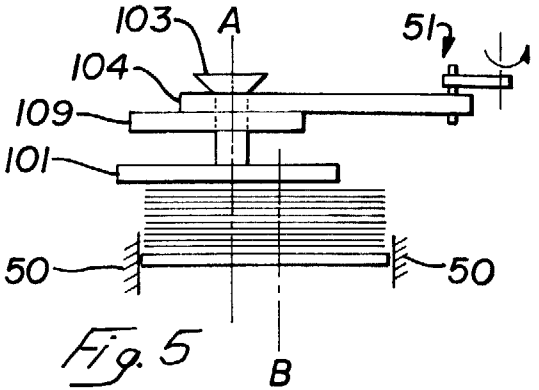
FIG. 5 is a schematic view of a further modification of the invention.

FIG. 5 shows the alternative mode of operation referred to above for effecting relative motion between the axis A of the depositing disc and the axis B of the receiving disc. In FIG. 5, the numerals correspond to the numerals of FIGS. 1 and 2 but have been raised by 100. Receiving plate 102 is non-rotatable, as represented by fixed vertical guides 50 in FIG. 5, and the depositing disc 101 with elements 103 and 109 attached thereto (identical to parts 3 and 9 in FIGS. 1 and 2) still rotates about axis A; but, in addition, the frame 104 revolves about fixed axis B of the receiving disc 102. Such revolving motion of frame 104 may be accomplished by a crank mechanism as shown in said U.S. Pat. No. 3,816,889, and as shown schematically at 51 in FIG. 5. This mode of operation is shown in greater detail in said U.S. Pat. No. 3,816,889.

It appears also evident, from the above, that an apparatus for producing a coiled thread package has been provided, in which a very efficient and dependable feeding of the thread to the depositing disc has been ensured, taking advantage of a feeder device (the fixed take-up member) which can be defined as static with respect to the prior art apparatuses, with all the advantages deriving from this construction.

It is believed that the invention will have been clearly understood from the foregoing detailed description of a preferred embodiment. Changes in the detail of construction may be resorted to without departing from the spirit of the invention, and it is accordingly intended that no limitation be implied and that the hereto annexed claims be given the broadest interpretation to which the employed language fairly admits.

I claim:

1. An apparatus for producing a coiled thread package constructed of a substantially continuous length of thread disposed in substantially annular layers forming a coil, each layer being constructed of a series of loops which progress along the annular layer of the coil, said apparatus comprising:

a. a receiving plate having a substantially vertical axis;

b. a frame structure, a thread depositing disc rotatably mounted on said frame structure, said disc being arranged so as to face said receiving plate and having a substantially vertical axis, said axis of said depositing disc being arranged eccentrically with respect to the axis of the receiving plate, said receiving plate and said depositing disc being capable of relative movement toward and away from each other in vertical direction;

c. means for yieldingly urging the said receiving plate and the said depositing disc into relative movement towards each other;

d. means for rotating the said depositing disc around its axis;

e. further means for causing a relative movement between the axis of the depositing disc and the receiving plate;

f. a through bore on the said depositing disc providing a passage for the thread to be deposited on the receiving plate;

g. a feeding device for the thread to be deposited on the receiving plate, said feeding device comprising:

1. inlet thread guiding means arranged co-axially with respect to the vertical axis of the said depositing disc;

2. draw-off thread guiding means integral in rotation with the depositing disc;

3. a thread take-up member fixedly secured to the frame structure which supports the depositing disc and arranged on the side of the said depositing disc which is opposite to the side which faces the receiving plate, said take-up member being stationary with respect to the rotational movement of the depositing disc and presenting an annular outer friction surface which is coaxial to the vertical axis of the depositing plate, whereby the thread coming from a suitable supply is guided by the said inlet thread guiding means to the said draw-off thread guiding means so as to be laid, on at least an arc of a circumference, onto said annular friction surface in a direction which is contrary to the direction of rotation of the depositing disc, passing from the said friction surface, to the said bore in the depositing disc, so as to be deposited on the said receiving plate upon rotation of the depositing disc, and relative movement between the axis of the depositing disc and the receiving plate.

2. An apparatus according to claim 1, wherein:

a. said further means comprises means for rotating the receiving plate about its vertical axis:

b. said axis of the depositing disc being a fixed vertical axis.

3. An apparatus according to claim 1, wherein:

a. the receiving plate is fixed against rotation about its axis, which is a fixed vertical axis;

b. the frame structure which carries the depositing disc being mounted for rotation around said fixed axis of the receiving plate.

4. An apparatus according to claim 1, wherein the draw-off thread guide and the through bore on the depositing disc are arranged as near as possible to the friction surface of the thread take-up member.

5. An apparatus according to claim 1, including a further thread guide on the depositing disc, in proximity of the through bore, for favoring the detachment of the thread from the friction surface of the take-up member.

6. An apparatus according to claim 5, including a blade-like member and wherein the said further thread guide for favoring the detachment of the thread from the friction surface is mounted in association with said blade-like member which has one end secured to the said thread guide, and the other free end inclined towards the said friction surface.

7. An apparatus according to claim 1, in which suitable pressure means are provided, at a location corresponding to the zone of tangency of the thread coming from the draw-off thread guide onto the friction surface, in order to promote the adhesion of the thread onto said friction surface.

8. An apparatus according to claim 1, said inlet thread guide means comprising a rotating hollow shaft, and wherein the depositing disc is carried by said rotating hollow shaft which has one extremity which is open and the other extremity which is integral with the side of said depositing disc which is opposed to the side facing the receiving plate, said hollow shaft being rotatably supported by the said frame structure and being provided with a radial bore in proximity of the said depositing disc.

9. An apparatus according to claim 1, in which the friction surface comprises a covering on the take-up member of a material having suitable friction characteristics.

10. An apparatus according to claim 1, in which the friction surface comprises a roughened surface on the material of the take-up member.

* * * * *